US009150298B2

(12) United States Patent
Mizushima

(10) Patent No.: US 9,150,298 B2
(45) Date of Patent: Oct. 6, 2015

(54) POWER SUPPLY SYSTEM FOR A BOAT

(75) Inventor: Yoshihiro Mizushima, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 579 days.

(21) Appl. No.: 12/652,050

(22) Filed: Jan. 5, 2010

(65) Prior Publication Data

US 2010/0174450 A1 Jul. 8, 2010

(30) Foreign Application Priority Data

Jan. 7, 2009 (JP) ..... 2009-001939

(51) Int. Cl.

| | |
|---|---|
| ***G06F 19/00*** | (2011.01) |
| ***G06F 7/00*** | (2006.01) |
| ***G06F 17/00*** | (2006.01) |
| ***B63J 3/02*** | (2006.01) |

(52) U.S. Cl.

CPC ..... *B63J 3/02* (2013.01)

(58) Field of Classification Search

CPC ..... B63J 3/02; B63J 2099/006; H02J 7/1423; H02J 7/34; H02J 7/3345; H02J 7/345; H02J 7/35; H02J 7/1446; H02J 4/00; H02J 2003/003; H02J 3/14; H02J 3/16; H02J 3/18; H02J 3/1892; H02J 3/38; H02J 9/002; B60W 10/08; B60W 10/26; B60W 2050/021; B60W 20/10; B60W 10/102

USPC ..... 701/36, 21, 99, 101

See application file for complete search history.

(56) References Cited

U.S. PATENT DOCUMENTS

| | | | | |
|---|---|---|---|---|
| 3,374,779 | A * | 3/1968 | Fergus | 123/179.1 |
| 5,696,679 | A * | 12/1997 | Marshall et al. | 701/53 |
| 5,866,995 | A * | 2/1999 | Indlekofer | 318/4 |
| 6,211,681 | B1 * | 4/2001 | Kagawa et al. | 324/426 |
| 2008/0129119 | A1 * | 6/2008 | Tonicello | 307/39 |

FOREIGN PATENT DOCUMENTS

| | | | |
|---|---|---|---|
| JP | 09-107639 | A | 4/1997 |
| JP | 2004-248416 | A | 9/2004 |
| JP | 2007-110855 | A | 4/2007 |
| JP | 2008-062712 | A | 3/2008 |

OTHER PUBLICATIONS

Official Communication issued in corresponding Japanese Patent Application No. 2009-001939, mailed on Jun. 25, 2013.

* cited by examiner

*Primary Examiner* — Mussa A Shaawat
*Assistant Examiner* — Kyung Kim
(74) *Attorney, Agent, or Firm* — Keating & Bennett, LLP

(57) ABSTRACT

A power supply system for a boat includes a generator, a rectifier circuit, a main electric system arranged to supply electric power to a control system that controls the boat propulsion system, the main electric system including a main battery, and an auxiliary electric system arranged to supply electric power to auxiliary equipment provided on the boat, the auxiliary electric system including an auxiliary battery. An operation signal supplied to an actuating device connected to the main electric system is detected, and in a case where it is decided, based on the detected signal, to prioritize the main electric system over the auxiliary electric system, current supply to the auxiliary electric system is restricted, to thereby attain a stable operation of the control system of the boat.

18 Claims, 8 Drawing Sheets

POWER SUPPLY SYSTEM FOR A BOAT

CROSS-REFERENCE TO RELATED APPLICATION

The present application claims priority from Japanese application JP 2009-001939 filed on Jan. 7, 2009, the entire contents of which are hereby incorporated by reference into this application.

BACKGROUND OF THE INVENTION

1. Field of the Invention

The present invention relates to a power supply system for a boat.

2. Description of the Related Art

Some boats are provided with a power supply system in which a three phase alternating-current generator provided for a boat propulsion system generates a current, and the generated current is supplied to a main electric system which includes a main battery for supplying electric power to a control system of the boat propulsion system and to an auxiliary electric system which includes an auxiliary battery for supplying electric power to boat equipment or the like. In recent years, it has become common for the boat equipment to include auxiliary devices such as a bow thruster or an air conditioner, which consume a large amount of electric power. When a load is increased due to the boat equipment as described above, the generated current flows for the most part into the auxiliary electric system side, with the result that the main battery side suffers a voltage drop.

In view of the above-mentioned problem, there has been conventionally proposed a technology in which when a voltage drop in the main battery is detected, current supply to the auxiliary electric system is stopped, to thereby prevent the voltage drop in the main battery (see JP 2007-110855 A).

Meanwhile, in a case where the boat is equipped with an actuating device, such as a power steering device, which momentarily requires a high current while being required to have high system performance (hereinafter, a description is given by taking power steering as an example), it is necessary to cause the steering motor to instantaneously operate in response to the operation of the steering unit. However, as in the case of the conventional technology described above, when the auxiliary electric system is isolated after a voltage drop in the main battery is detected, the voltage of the main electric system has already dropped when driving the steering motor, which could affect the optimal drive performance of the steering motor.

SUMMARY OF THE INVENTION

Preferred embodiments of the present invention provide a power supply system for a boat, in which a voltage drop in a main electric system is prevented, to thereby attain a stable operation of an actuating device connected to the main electric system.

A power supply system for a boat according to a preferred embodiment of the present invention includes a generator arranged to generate electric power in conjunction with driving of an internal combustion engine provided in a boat propulsion system; a rectifier circuit arranged to convert an alternating current output from the generator to a direct current; a main electric system arranged to supply electric power to a control system controlling the boat propulsion system, the main electric system including a first storage battery to be charged by the direct current output from the rectifier circuit;

an auxiliary electric system arranged to supply electric power to auxiliary equipment provided on the boat, the auxiliary electric system including a second storage battery to be charged by the direct current output from the rectifier circuit; an actuating device arranged to actuate the boat propulsion system, the actuating device being connected to the main electric system, a detector arranged to detect an operation signal supplied to the actuating device; a deciding device arranged to decide, based on the operation signal detected by the detector, whether or not to prioritize the main electric system over the auxiliary electric system; and restricting device arranged to restrict current supply to the auxiliary electric system when the deciding device decides to prioritize the main electric system.

Further, according to another preferred embodiment of the present invention, the actuating device is driven after the current supply to the auxiliary electric system has been restricted by the restricting device.

Further, according to a further preferred embodiment of the present invention, the power supply system further includes a calculating device arranged to calculate a drive current amount to drive the actuating device, based on the operation signal detected by the detector, and the restricting device is arranged to restrict the current supply to the auxiliary electric system based on the drive current amount calculated by the calculating device.

Further, according to a still further preferred embodiment of the present invention, the deciding device is arranged to decide to prioritize the main electric system over the auxiliary electric system, in a case where an amount of change in the operation signal supplied to the actuating device detected by the detect device is equal to or larger than a threshold value.

Further, according to a yet further preferred embodiment of the present invention, the actuating device is a steering motor for turning the boat propulsion system from side to side with respect to a traveling direction of the boat.

Further, according to a yet further preferred embodiment of the present invention, when a difference between a control target position of the steering motor calculated based on the operation signal detected by the detector and an actual position of the steering motor is equal to or larger than a threshold value, it is decided to prioritize the main electric system over the auxiliary electric system.

Further, according to a yet further preferred embodiment of the present invention, the power supply system further includes a connection control device programmed to control a connection between the rectifier circuit and the auxiliary electric system, and the restricting device is arranged to control the connection control device, to thereby stop the current supply to the auxiliary electric system.

Further, according to another preferred embodiment of the present invention, a boat includes a generator arranged to generate electric power in conjunction with driving of an internal combustion engine provided in a boat propulsion system; a rectifier circuit arranged to convert an alternating current output from the generator to a direct current; a main electric system arranged to supply electric power to a control system controlling the boat propulsion system, the main electric system including a first storage battery to be charged by the direct current output from the rectifier circuit; an auxiliary electric system arranged to supply electric power to auxiliary equipment provided on the boat, the auxiliary electric system including a second storage battery to be charged by the direct current output from the rectifier circuit; an actuating device arranged to actuate the boat propulsion system, the actuating device being connected to the main electric system; a detector arranged to detect an operation signal supplied to the actuating device; a deciding device arranged to decide, based on the operation signal detected by the detector, whether or not to prioritize the main electric system over the auxiliary electric system; and restricting device arranged to restrict current supply to the auxiliary electric system when the deciding device decides to prioritize the main electric system.

Further, yet another preferred embodiment of the present invention provides a control method of controlling a power supply system for a boat, the power supply system including a generator arranged to generate electric power in conjunction with driving of an internal combustion engine provided in a boat propulsion system; a rectifier circuit arranged to convert an alternating current output from the generator to a direct current; a main electric system arranged to supply electric power to a control system controlling the boat propulsion system, the main electric system including a first storage battery to be charged by the direct current output from the rectifier circuit; an auxiliary electric system arranged to supply electric power to auxiliary equipment provided to the boat, the auxiliary electric system including a second storage battery to be charged by the direct current output from the rectifier circuit; and an actuating device arranged to actuate the boat propulsion system, the actuating device being connected to the main electric system, the control method including the steps of detecting an operation signal supplied to the actuating device; deciding, based on the detected operation signal, whether or not to prioritize the main electric system over the auxiliary electric system; and, when it has been decided to prioritize the main electric system, restricting current supply to the auxiliary electric system.

Further, according to another preferred embodiment of the present invention, the actuating device is preferably driven after the current supply to the auxiliary electric system has been restricted.

Further, according to a further preferred embodiment of the present invention, the control method further includes the step of calculating a drive current amount for driving the actuating device, based on the detected operation signal, and the restricting step includes restricting the current supply to the auxiliary electric system based on the calculated drive current amount.

Further, according to a still further preferred embodiment of the present invention, the deciding step includes deciding to prioritize the main electric system over the auxiliary electric system, in a case where a detected amount of change in the operation signal supplied to the actuating device is equal to or larger than a threshold value.

According to various preferred embodiments of the present invention, a voltage drop in the main electric system is prevented, to thereby attain a stable operation of the actuating device connected to the main electric system.

According to various preferred embodiments of the present invention, the actuating device is preferably driven while being supplied with a current in a state where power supply to the auxiliary electric system is restricted, to thereby attain a stable operation of the actuating device.

According to various preferred embodiments of the present invention, current supply to the auxiliary electric system may be restricted according to a drive current amount to be supplied to the actuating device.

According to various preferred embodiments of the present invention, current supply to the auxiliary electric system is restricted according to an amount of operation of the actuating device, to thereby attain a stable operation of the actuating device.

According to various preferred embodiments of the present invention, current supply to the auxiliary electric system is preferably restricted in a case where it is decided to prioritize current supply to the steering motor, to thereby attain a stable operation of the steering motor.

According to various preferred embodiments of the present invention, current supply to the auxiliary electric system is restricted based on an amount of operation of the steering motor, to thereby attain a stable operation of the steering motor.

According to various preferred embodiments of the present invention, current supply to the auxiliary electric system is stopped in a case where it is decided to prioritize the main electric system side, to thereby prevent a voltage drop in the main electric system.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

In the following, preferred embodiments for implementing the present invention (hereinafter, referred to as preferred embodiments) are described with reference to the accompanying drawings.

Figure 1:
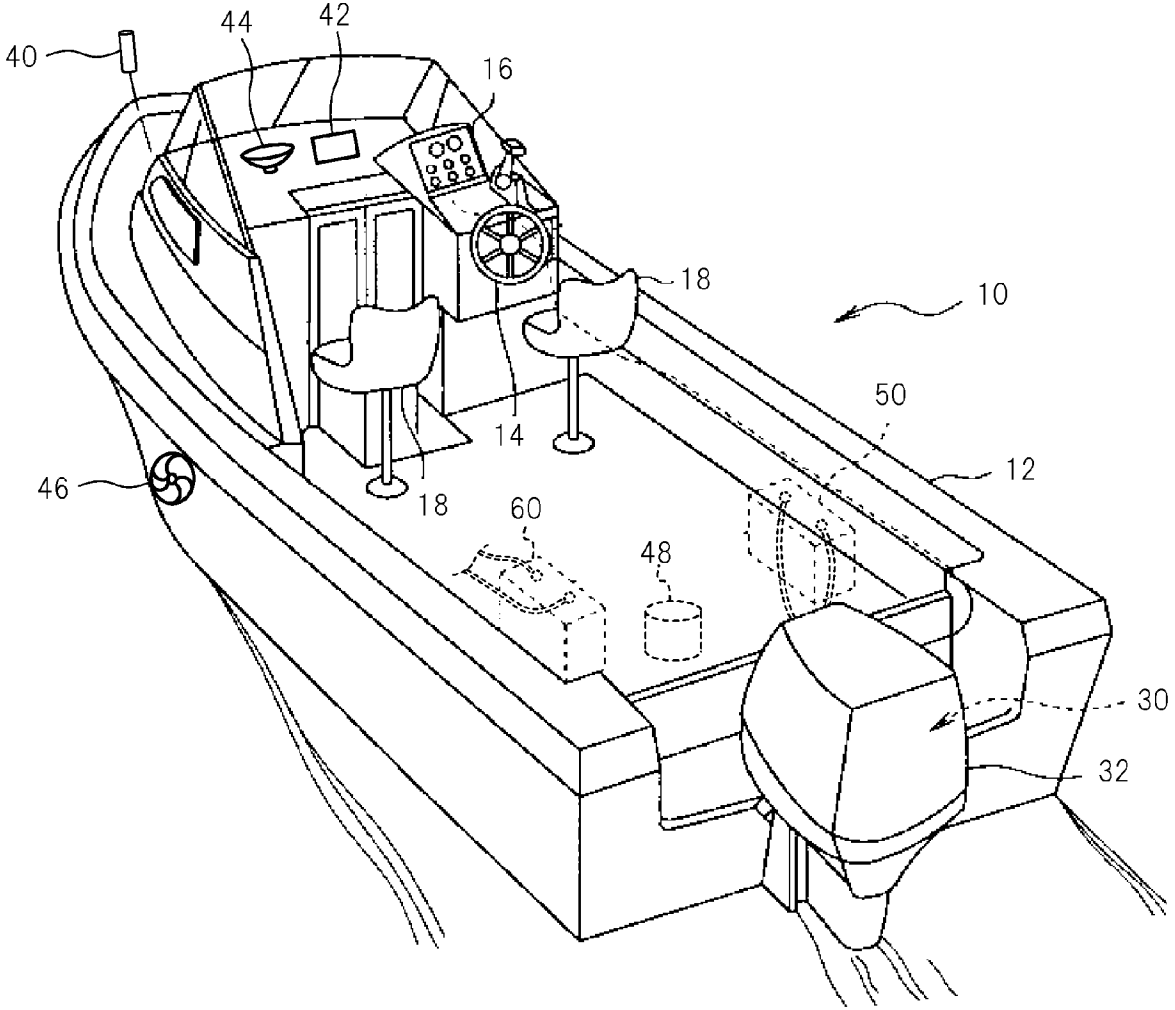
FIG. 1 is a configuration diagram illustrating a boat according to a first preferred embodiment of the present invention.

FIG. 1 is a configuration diagram of a boat 10 according to a first preferred embodiment of the present invention. As illustrated in FIG. 1, the boat 10 preferably includes a ship body 12 of an open deck type, which includes a helm position at the front thereof. The helm position is provided with a steering wheel 14, a measuring instrument 16, seats 18, and the like. At the stern, a boat propulsion system 30 is mounted on a clamp bracket. Further, the boat 10 is provided with various accessories (auxiliary equipment), such as the measuring instrument 16, lighting 40, a fishfinder 42, a GPS antenna 44, a bow thruster 46, and a bilge pump 48. Still further, below the deck of the ship body 12, there is provided an electric system including a main battery (which corresponds to a first storage battery according to a preferred embodiment of the present invention) 50 arranged to supply electric power to a control system programmed to control the boat propulsion system 30 and an auxiliary battery (which corresponds to a second storage battery according to a preferred embodiment of the present invention) 60 arranged to supply electric power to the various accessories.

The boat propulsion system 30 functions as a propulsion unit of the boat 10, and includes, in a case 32 of the boat propulsion system 30, an internal combustion engine, an engine control unit (ECU) programmed to control an operation of the internal combustion engine, a power transmitting device arranged to transmit power generated by the internal combustion engine to a propeller immersed under water, various motors for changing the posture of the boat propulsion system 30 from side to side and up and down, and a generator arranged to generate electric power in conjunction with the driving of the internal combustion engine.

Figure 2:
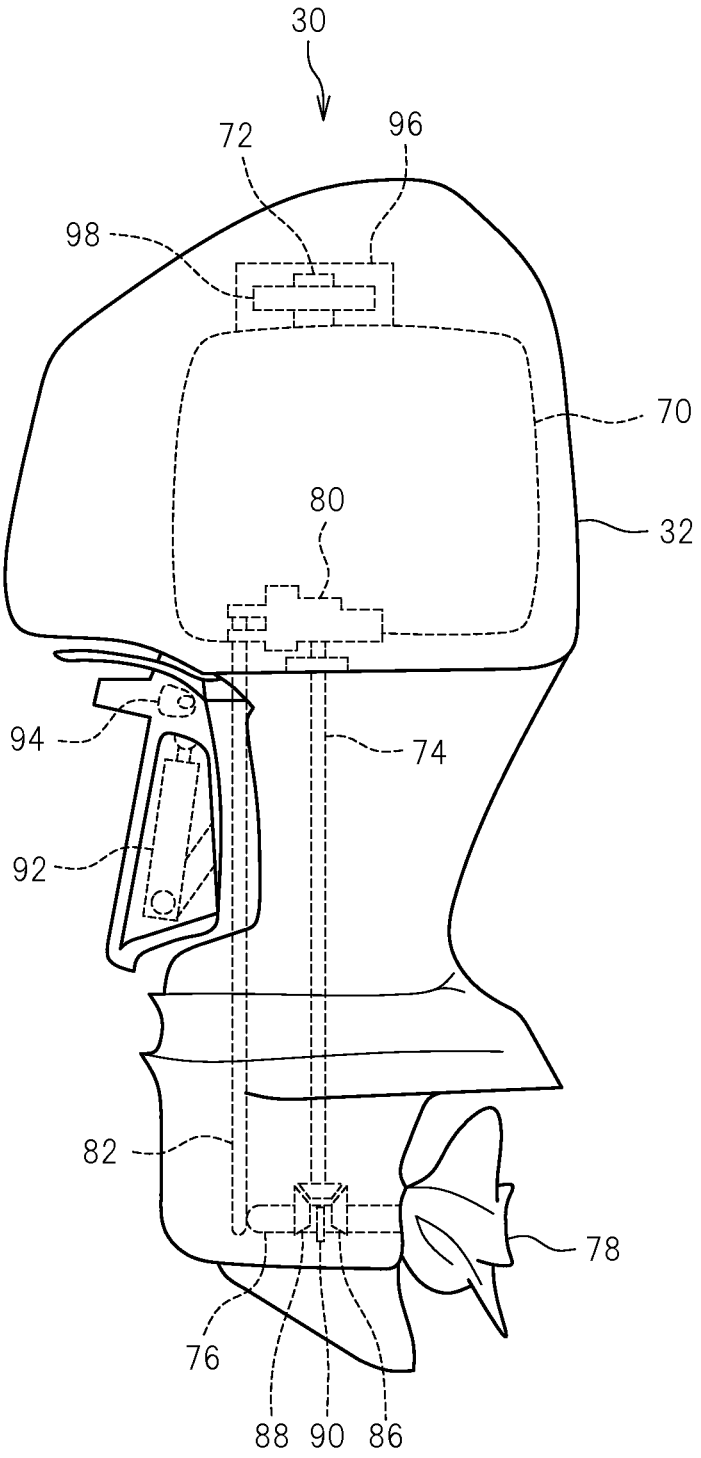
FIG. 2 is a side view of a boat propulsion system.

FIG. 2 is a side view of the boat propulsion system 30, in which some of the devices provided inside the case 32 of the boat propulsion system 30 are illustrated by dotted lines. As illustrated in FIG. 2, the boat propulsion system 30 includes the internal combustion engine 70, a crankshaft 72 arranged to extract, as a rotary motion, power generated in the internal combustion engine 70, a drive shaft 74 arranged to transmit the rotary motion of the crank shaft 72 to a propeller shaft 76, and a propeller 78 connected to the propeller shaft 76. The rotation of the propeller 78 generates propulsion power for the boat 10.

Further, the boat propulsion system 30 includes a shift motor 80 which is disposed at the bottom of the internal combustion engine 70 and operates under the control of the ECU, a shift shaft 82 which is turned by the shift motor 80, and a shift switching device 90 arranged to switch a gear, which is engaged with the drive shaft 74, to one of a forward gear 86, a reverse gear 88, and neutral, in accordance with the turning of the shift shaft 82, to thereby switch the traveling direction among a forward direction, an independent (neutral) direction, and a reverse direction.

Further, the boat propulsion system 30 includes a power tilt/trim unit in the vicinity of a position at which the boat propulsion system 30 is attached to the ship body 12. The power tilt/trim unit includes a power tilt/trim motor 92, which is attached by coupling at both ends thereof to the ship body 12 and the boat propulsion system 30, respectively. The power tilt/trim motor 92 is extended and contracted in accordance with the control performed by the ECU, to thereby turn the boat propulsion system 30 around the tilt shaft vertically with respect to the ship body 12. It should be noted that a trim operation refers to an operation in a range of relatively small tilt angle, which is mainly used, for example, when traveling at high speed, while a tilt operation refers to an operation in a range of relatively large tilt angle, which is used, for example, when traveling at low speed in shallow waters or when landing the boat 12.

The boat propulsion system 30 further includes a steering motor (which corresponds to an actuating device according to a preferred embodiment of the present invention) 94 in the vicinity of the position at which the boat propulsion system 30 is attached to the ship body 12. The steering motor 94 is operated in accordance with the control performed by the ECU, to thereby turn the boat propulsion system 30 from side to side with respect to the traveling direction of the ship body 12. An operation amount of the steering wheel 14 provided at the helm position of the ship body 12 is detected by a sensor provided in the steering wheel 14, and the detected operation amount is transmitted to the ECU through a wire, for example. Then, the ECU generates a drive signal based on the transmitted operation amount, and outputs the generated drive signal supplied to the steering motor 94, to thereby drive the steering motor 94.

The generator 96 preferably is a three phase alternating current generator, and includes a flywheel magnet 98 which rotates in conjunction with the crankshaft 72 of the internal combustion engine 70. A current generated by the generator 96 is supplied to the control system including the above-mentioned ECU of the boat propulsion system 30, and is further supplied to auxiliary devices (accessories) such as the lighting 40 and the bow thruster 46 provided on the boat 10. In the following, a power supply system for supplying electric power to the control system and the auxiliary devices is described in detail.

Figure 3:
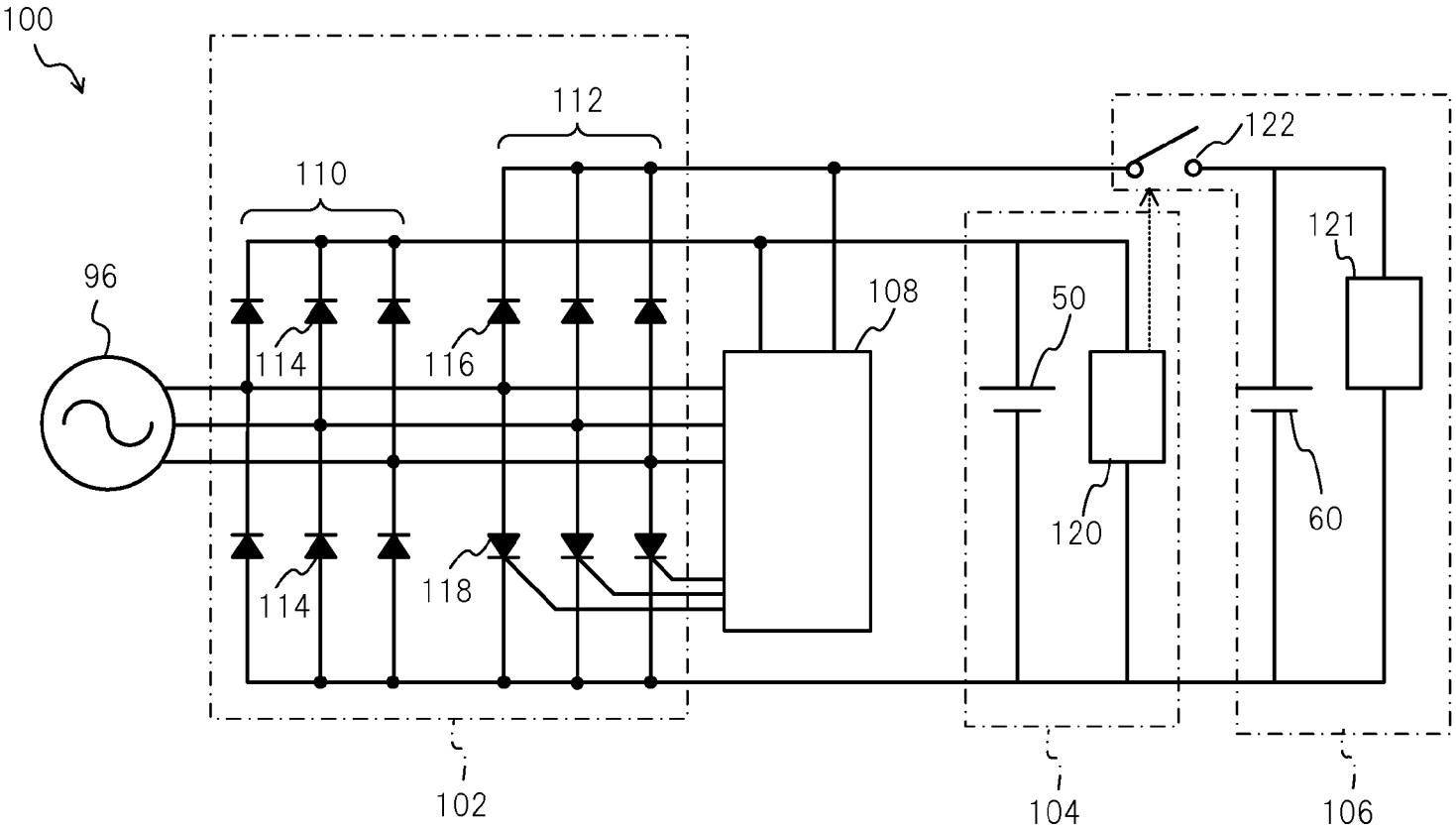
FIG. 3 is an electric wiring diagram of a power supply system.

FIG. 3 is an electric wiring diagram of a power supply system 100 according to the first preferred embodiment. As illustrated in FIG. 3, the power supply system 100 includes the generator 96, a rectifier circuit 102, a main electric system 104, an auxiliary electric system 106, and a voltage control circuit 108.

The rectifier circuit 102 preferably is a three phase full-wave rectifier circuit, and includes a first three-phase bridge 110 and a second three-phase bridge 112. Each arm defining the first three-phase bridge 110 is provided with diodes 114 connected in series in a forward direction from a negative electrode to a positive electrode. Each arm defining the second three-phase bridge 112 is provided with a diode 116 having a cathode connected to a positive electrode and a thyristor 118 having an anode connected to a negative electrode. A three-phase alternating current output from the generator 96 is input to connection nodes each provided at a middle point of each arm, and subjected to full-wave rectification, to thereby generate a direct-current voltage between the positive electrode and the negative electrode of each of the three-phase bridges.

The main electric system 104 includes the main battery 50 and electric wiring, which connect to the control system 120 programmed to control the boat propulsion system 30 and supply electric power to the control system 120. The main electric system 104 connects to the first three-phase bridge 110 of the rectifier circuit 102. An alternating current output from the generator 96 is converted to a direct current by the rectifier circuit 102, and supplied to the control system 120 and the main battery 50. The steering motor 94 connects to the main electric system 104 and is supplied with electric power from the main electric system 104. Electrical control to be performed when driving the steering motor 94 is described later in detail.

The auxiliary electric system 106 includes the auxiliary battery 60, electric wiring, and an auxiliary connection switch (which corresponds to connection control device of the present invention) 122, which connect to a load 121 including the accessories (auxiliary equipment) such as the lighting 40 and the bow thruster 46 provided on the boat 10, and supplies electric power to the load 121. The auxiliary electric system 106 connects to the second three-phase bridge 112 of the rectifier circuit 102. An alternating current output from the generator 96 is converted to a direct current by the rectifier circuit 102 and supplied to the load 121 and the auxiliary battery 60. The auxiliary connection switch 122 is provided at a connection point of the auxiliary electric system 106 and the rectifier circuit 102, and the auxiliary connection switch 122 is controlled by the ECU 150 included in the control system 120. When the auxiliary connection switch 122 is turned off, current supply from the generator 96 to the auxiliary electric system 106 is stopped, while a current generated during this time is supplied to the main electric system 104.

The voltage control circuit 108 connects to the positive electrodes and connection nodes of the first three-phase bridge 110 and the second three-phase bridge 112 and measures voltages of the main battery 50 and the auxiliary battery 60. The voltage control circuit 108 also connects to the gates of the thyristors 118 to control the turning on and off of the thyristors 118, to thereby control a current flowing through the diodes 116 of the rectifier circuit 102 and perform charge control or the like of the batteries. Specifically, in a case where a voltage measured with respect to one of the main battery 50 and the auxiliary battery 60 exceeds a threshold voltage indicating a full charge, the voltage control circuit 108 outputs a gate signal supplied to the thyristors 118 so as to turn on the thyristors 118. As a result, a current output from the generator 96 circulates between the rectifier circuit 102 and the generator 96 without being supplied to the battery side, with the result that the batteries are prevented from being overcharged.

Figure 4:
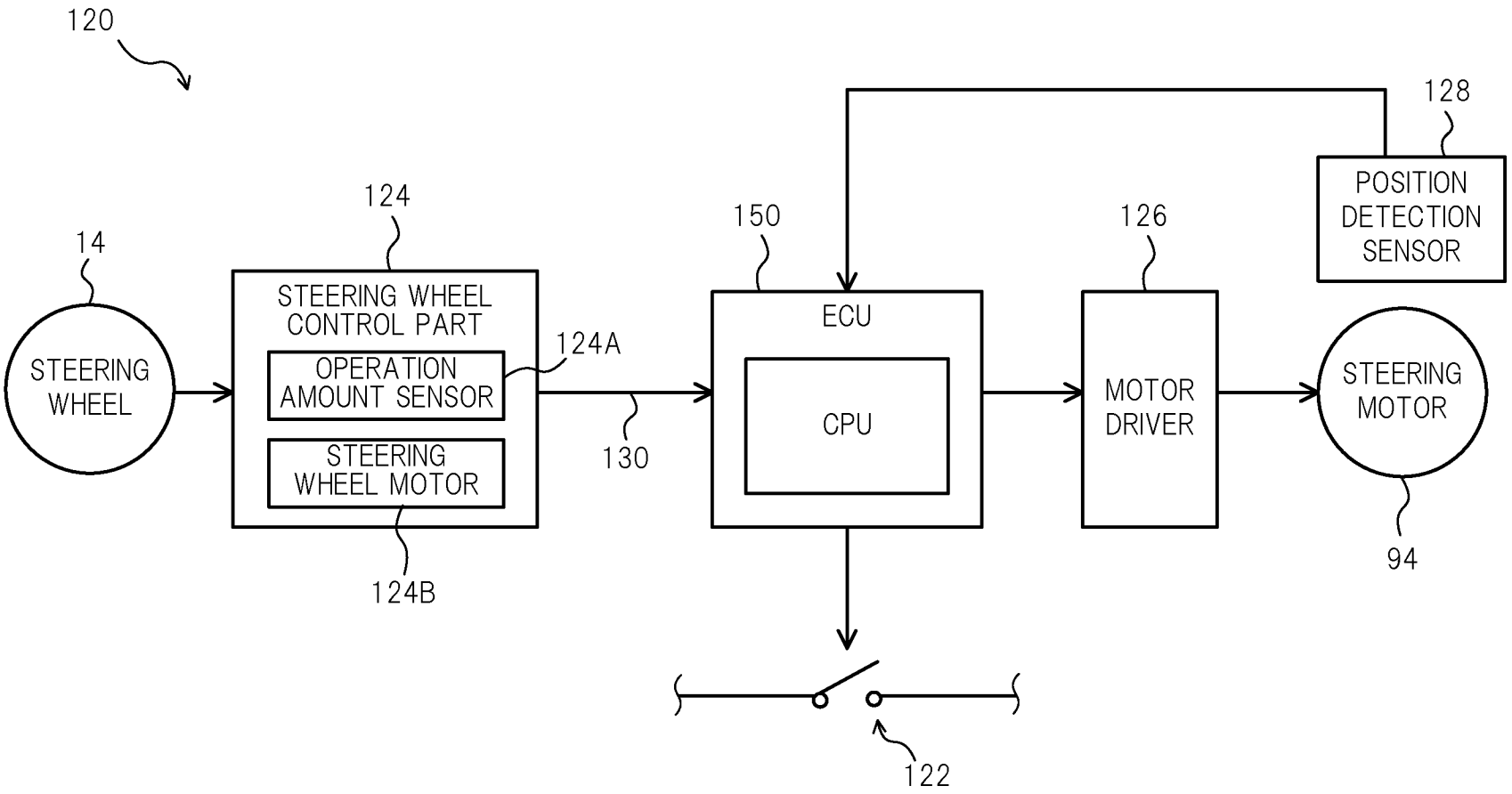
FIG. 4 is a diagram illustrating an example of a control system.

Next, an operation of the control system 120 will be described with reference to an example of the control system 120 illustrated in FIG. 4. The control system 120 includes the steering wheel 14, a steering wheel control part 124, the ECU 150, a motor driver 126, the steering motor 94, and a position detection sensor 128. Each of the devices is supplied with drive power from the main electric system 104.

The steering wheel 14 is a steering device provided at the helm position. The steering wheel 14 is provided, at a base portion of a steering wheel shaft thereof, with a steering wheel control part 124 which includes an operation amount (for example, operation angle) sensor (which corresponds to a detector according to a preferred embodiment of the present invention) 124A and a steering wheel motor 124B. The steering wheel control part 124 is connected to the ECU 150 through a signal cable 130.

The ECU 150 is a control unit for the boat propulsion system 30, and includes a central processing unit (CPU). The ECU 150 operates by reading programs stored in a memory or the like in advance, to thereby implement various functions such as a deciding device, a restricting device, and a calculating device according to a preferred embodiment of the present invention. Specifically, the ECU 150 calculates a steering angle based on a detection signal from the operation amount sensor 124A and a detection signal from the position detection sensor 128 arranged to detect an actual position of the steering motor 94, and inputs the calculated steering angle to the motor driver 126. The motor driver 126 outputs a drive current determined based on the steering angle input from the ECU 150 to the steering motor 94 so as to drive the steering motor 94, to thereby turn the boat propulsion system 30 in a horizontal direction.

Further, the ECU 150 detects, using a sensor (not shown) provided to the boat propulsion system 30, an external force acting on the boat propulsion system 30, and based on the detected external force, calculates a target value of an anti-torque to be applied to the steering wheel 14 from the steering wheel motor 124B against the external force. The ECU 150 drives the steering wheel motor 124B based on the calculated target value, to thereby impart a reactive force to the steering wheel 14.

In the first preferred embodiment, the auxiliary connection switch 122 of the auxiliary electric system 106 is turned off before starting to drive the steering motor 94, so that the main electric system 104 is prioritized to receive current supply, to thereby perform control such that the steering motor 94 may be driven without causing a voltage drop in the main electric system 104. In the following, control performed by the ECU 150 starting from detecting the operation signal of the steering wheel 14 to driving the steering motor 94 is specifically described, with reference to the flowcharts illustrated in FIGS. 5 to 7.

Figure 5:
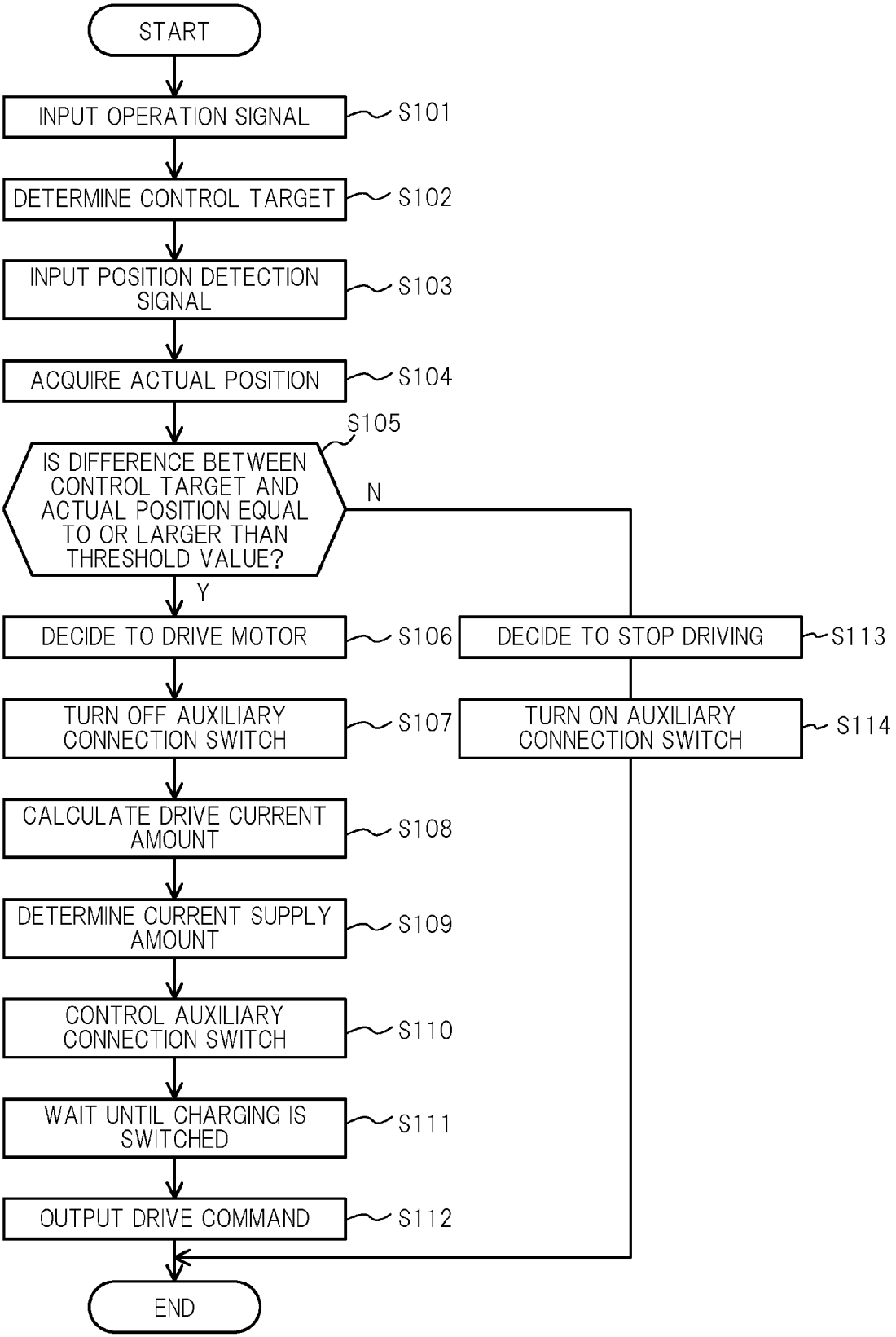
FIG. 5 is a flow chart for illustrating control processing according to a first example of a preferred embodiment of the present invention.

FIG. 5 is a flow chart for illustrating control processing performed by the ECU 150 according to a first example. In the first example, the ECU 150 receives an input of an operation signal (voltage signal) from the operation amount sensor 124A (S101), and determines a control target position of the steering motor 94 (S102). Further, the ECU 150 receives an input of a position detection signal (voltage signal) from the position detection sensor 128 (S103), and acquires an actual position of the steering motor 94 (S104). Then, the ECU 150 judges whether or not the difference between the control target position and the actual position of the steering motor 94 is equal to or larger than a threshold value (S105), and in a case where it is judged that the difference is equal to or larger than the threshold value (S105:Y), the ECU 150 decides to drive the steering motor 94 (S106), while turning off the auxiliary connection switch 122 (S107) to stop current flowing into the auxiliary electric system 106, prioritizing the main electric system 104.

Next, the ECU 150 calculates a drive current amount for the steering motor 94 based on the difference between the control target position and the actual position of the steering motor 94 (S108), determines a current supply amount for the main electric system 104 based on the calculated drive current amount (S109), and controls the auxiliary connection switch 122 based on the determined current supply amount (S110). The control of the auxiliary connection switch 122 may be performed through, for example, duty control, in which a turned-on period and a turned-off period of the auxiliary connection switch 122 are switched so that a predetermined charging rate (for example, of 50%) is attained in the main battery 50.

Then, the ECU 150 waits until the charging is switched (S111), outputs a drive command to the motor driver 126 (S112), and ends the processing. It should be noted that in a case where it is judged in S105 that the difference between the control target position and the actual position of the steering motor 94 is less than the threshold value (S105:N), the ECU 150 decides to stop driving the steering motor 94 (S113), turns on the auxiliary connection switch 122 (S114), and ends the processing.

In the control processing performed by the ECU 150 according to the first example, the current supply to the auxiliary electric system 106 is stopped immediately after it is decided to drive the steering motor 94, and the steering motor 94 is driven after evading the voltage drop in the main battery 50, to thereby attain a stable operation of the steering motor 94. Further, a current may be appropriately divided between the main electric system 104 and the auxiliary electric system 106 according to the duty control performed in accordance with a drive current amount for the steering motor 94.

Figure 6:
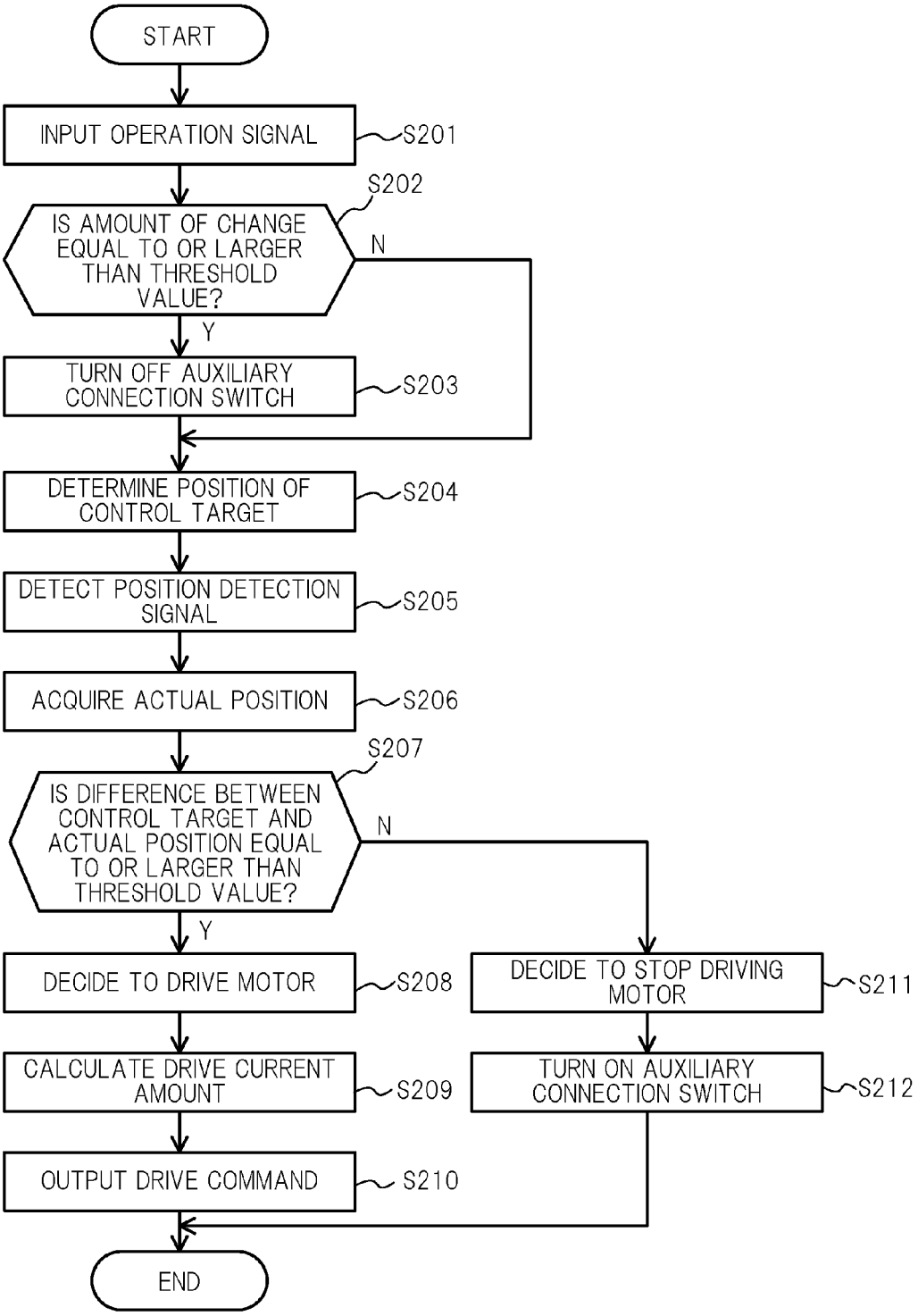
FIG. 6 is a flow chart for illustrating control processing according to a second example of a preferred embodiment of the present invention.

Next, with reference to the flow chart of FIG. 6, control processing performed by the ECU 150 according to a second example will be described. As illustrated in FIG. 6, the ECU 150 receives an input of an operation signal from the operation amount sensor 124A (S201), and judges whether or not the amount of change in the input operation signal is equal to or larger than a threshold value (S202), and in a case where it is judged that the amount of change is equal to or larger than the threshold value (S202:Y), the ECU 150 turns off the auxiliary connection switch 122 (S203) to stop current flowing into the auxiliary electric system 106, prioritizing the main electric system 104.

The ECU 150 determines a control target position of the steering motor 94, based on the input from the operation amount sensor 124A (S204), receives an input of a position detection signal (voltage signal) from the position detection sensor 128 (S205), and acquires an actual position of the steering motor 94 (S206). Then, the ECU 150 judges whether or not the difference between the control target position and the actual position of the steering motor 94 is equal to or larger than a threshold value (S207), and in a case where it is judged that the difference is equal to or larger than the threshold value (S207:Y), the ECU 150 decides to drive the steering motor 94 (S208). The ECU 150 calculates a drive current amount for the steering motor 94 based on the difference between the control target position and the actual position of the steering motor 94 (S209), outputs a drive command to the motor driver 126, based on the calculated drive current amount (S210), and ends the processing. Alternatively, in a case where it is judged in S207 that the difference between the control target position and the actual position of the steering motor 94 is less than the threshold value (S207:N), the ECU 150 decides to stop driving the steering motor 94 (S211), turns on the auxiliary connection switch 122 (S212), and ends the processing.

In the control processing performed by the ECU 150 according to the second example, in a case where the amount of change in the operation signal based on the operation of the steering wheel 14 is equal to or larger than a threshold value, the current supply to the auxiliary electric system 106 is immediately stopped without waiting for the judgment to be made as to whether or not to drive the steering motor 94, to thereby attain a stable operation of the steering motor 94 with higher responsivity compared with the first example, as well as to prevent a voltage drop in the main electric system 104.

Figure 7:
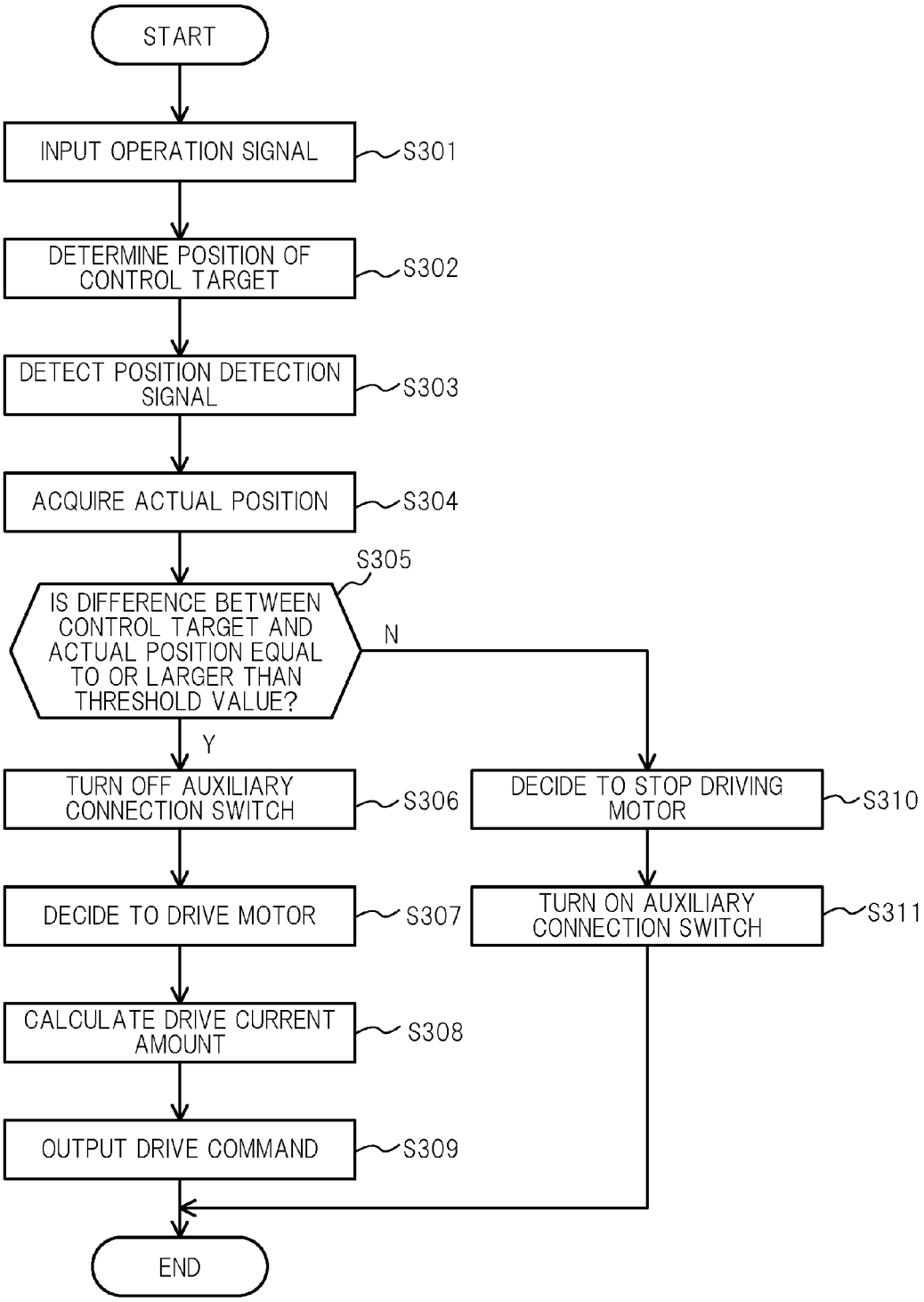
FIG. 7 is a flow chart for illustrating control processing according to a third example of a preferred embodiment of the present invention.

Next, with reference to the flow chart of FIG. 7, control processing performed by the ECU 150 according to a third example will be described. As illustrated in FIG. 7, the ECU 150 receives an input of an operation signal (voltage signal) from the operation amount sensor 124A (S301), determines a control target position of the steering motor 94 (S302), receives an input of a position detection signal (voltage signal) from the position detection sensor 128 (S303), and acquires an actual position of the steering motor 94 (S304). Then, the ECU 150 judges whether or not the difference between the control target position and the actual position of the steering motor 94 is equal to or larger than a threshold value (S305), and in a case where it is judged that the difference is equal to or larger than the threshold value (S305:Y), the ECU 150 turns off the auxiliary connection switch 122 (S306) to stop current flowing into the auxiliary electric system 106, prioritizing the main electric system 104.

The ECU 150 then decides to drive the steering motor 94 (S307), calculates a drive current amount for the steering motor 94 based on the difference between the control target position and the actual position of the steering motor 94 (S308), outputs a drive command to the motor driver 126, based on the calculated drive current amount (S309), and ends the processing. Alternatively, in a case where it is judged in S305 that the difference between the control target position and the actual position of the steering motor 94 is less than the threshold value (S305:N), the ECU 150 decides to stop driving the steering motor 94 (S310), turns on the auxiliary connection switch 122 (S311), and ends the processing.

In the control processing performed by the ECU 150 according to the third example, in a case where it is judged that the difference between the control target position and the actual position of the steering motor 94 based on the operation of the steering wheel 14 is equal to or larger than a threshold value, the current supply to the auxiliary electric system 106 is immediately stopped without waiting for the judgment to be made as to whether or not to drive the steering motor 94, to thereby attain a stable operation of the steering motor 94 with higher responsivity compared with the first example, as well as to prevent a voltage drop in the main electric system 104.

According to the power supply system 100 of the first preferred embodiment described above, current supply to the auxiliary electric system 106 is restricted so that a current is preferentially supplied to the main electric system 104, before driving the steering motor 94, to thereby prevent a voltage drop in the main electric system 104 from being caused due to an inrush current occurring when driving the steering motor 94, with the result that the steering motor 94 may be stably operated even with a steady current consumed after the inrush current.

Figure 8:
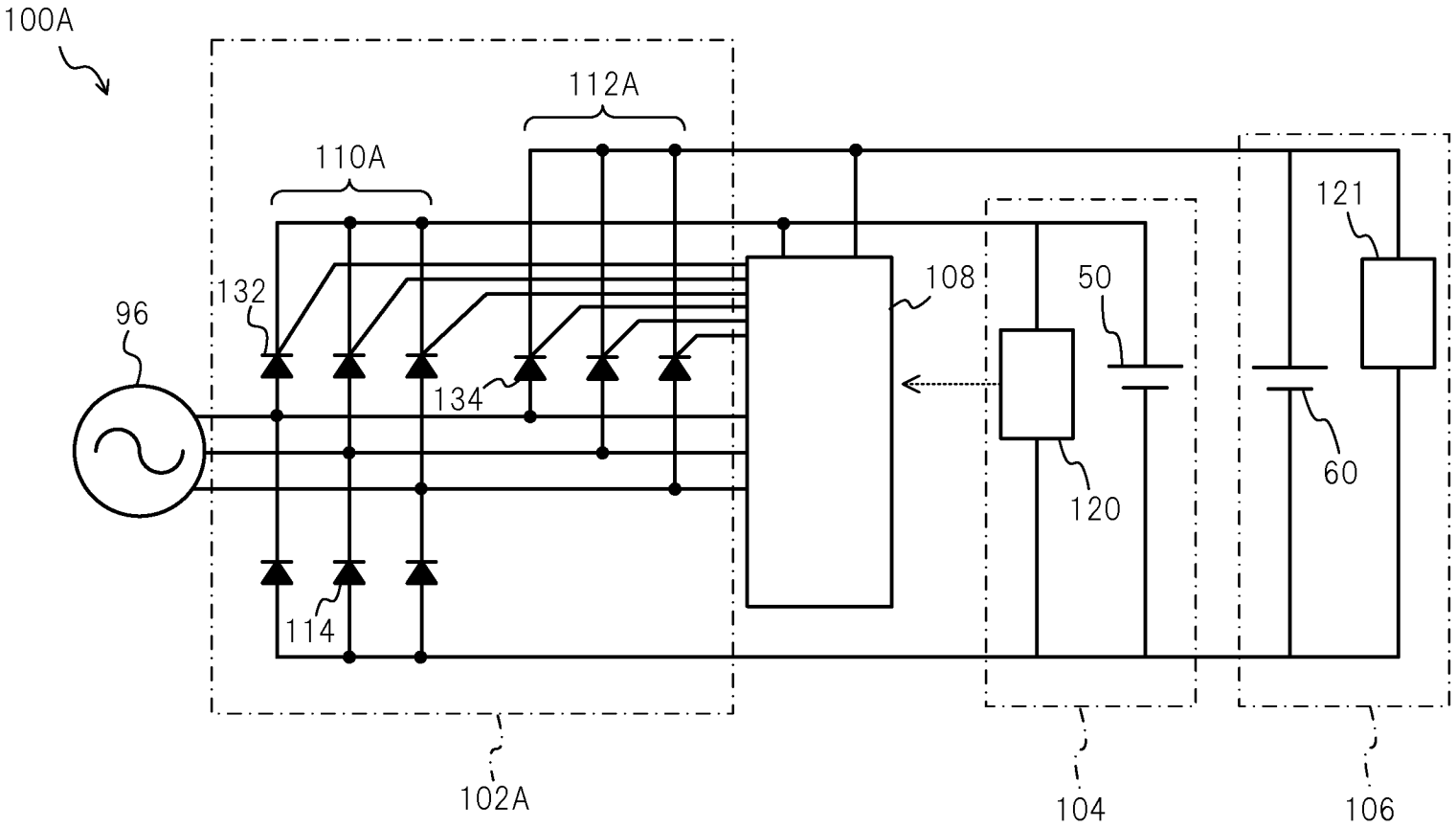
FIG. 8 is an electric wiring diagram of a power supply system according to a second preferred embodiment of the present invention.

Next, a power supply system 100 according to a second preferred embodiment will be described. FIG. 8 is an electric wiring diagram of the power supply system 100 according to the second preferred embodiment. According to the second preferred embodiment, a first three-phase bridge 110A of a rectifier circuit 102A includes switching elements 132 (thyristors) on a positive electrode side thereof, and further a second three-phase bridge 112A of the rectifier circuit 102A includes switching elements 134 (thyristors), to thereby replace the auxiliary connection switch 122 of the first preferred embodiment. The gates of the switching elements (thyristors) 132 of the rectifier circuit 102A according to the second preferred embodiment are connected to the voltage control circuit 108, and controlled by the voltage control circuit 108. Further, the voltage control circuit 108 receives a control signal for connecting/disconnecting the auxiliary electric system 106 from the ECU 150, and turns the switching elements 134 of the second three-phase bridge 112A on and off. The control processing to be performed by the ECU 150 in the second preferred embodiment is similar to the processing in the first preferred embodiment described above, and therefore the description thereof is omitted.

According to the power supply system 100 of the second preferred embodiment described above, the auxiliary connection switch 122 between the rectifier circuit 102 and the auxiliary electric system 106 may be omitted, and hence the number of components may be reduced. Reducing the number of components is highly effective when internal space is limited, as in the case of the boat propulsion system 30.

It should be noted that the present invention is not limited to the preferred embodiments described above. In the preferred embodiments described above, a description is given of control performed in a case of driving the steering motor 94. Alternatively, the control to restrict current supply to the auxiliary electric system 106 may also be performed in a case of driving the power tilt/trim motor 92 or the shift motor 80.

While there have been described what are at present considered to be certain preferred embodiments of the present invention, it will be understood that various modifications may be made thereto, and it is intended that the appended claims cover all such modifications as fall within the true spirit and scope of the present invention.

What is claimed is:

1. A power supply system for a boat comprising:

a generator arranged to generate electric power in conjunction with driving of an internal combustion engine provided in a boat propulsion system;

a rectifier circuit arranged to convert an alternating current output from the generator to a direct current;

a main electric system arranged to supply electric power to a control system controlling the boat propulsion system, the main electric system including a first storage battery to be charged by the direct current output from the rectifier circuit;

an auxiliary electric system arranged to supply electric power to auxiliary equipment provided on the boat, the auxiliary electric system including a second storage battery to be charged by the direct current output from the rectifier circuit;

an actuating device arranged to actuate the boat propulsion system, the actuating device being connected to the main electric system;

a detector arranged to detect an operation signal supplied to the actuating device;

a deciding device arranged to decide, based on the operation signal detected by the detector, whether or not to prioritize the main electric system over the auxiliary electric system; and a restricting device arranged to restrict, when the deciding device decides to prioritize the main electric system, current supply to the auxiliary electric system before driving the actuating device to supply electric current to the main electric system in priority to the auxiliary electric system, and to drive the actuating device after the restriction of the current supply to the auxiliary electric system; wherein the actuating device includes a motor; and the operation signal is a drive signal to the motor, wherein the main electric system and the auxiliary electric system are connected in parallel with respect to each other and with respect to the rectifier circuit.

2. The power supply system for a boat according to claim 1, wherein the actuating device is driven after the current supply to the auxiliary electric system has been restricted by the restricting device.

3. The power supply system for a boat according to claim 1, further comprising a calculating device arranged to calculate a drive current amount used to drive the actuating device, based on the operation signal detected by the detector, wherein the restricting device is arranged to restrict the current supply to the auxiliary electric system based on the drive current amount calculated by the calculating device.

4. The power supply system for a boat according to claim 1, wherein the deciding device is arranged to decide to prioritize the main electric system over the auxiliary electric system when an amount of change in the operation signal supplied to the actuating device detected by the detector is equal to or larger than a threshold value.

5. The power supply system for a boat according to claim 1, wherein the motor is a steering motor arranged to turn the boat propulsion system from side to side with respect to a traveling direction of the boat.

6. The power supply system for a boat according to claim 5, wherein, when a difference between a control target position of the steering motor calculated based on the operation signal detected by the detector and an actual position of the steering motor is equal to or larger than a threshold value, the deciding device decides to prioritize the main electric system over the auxiliary electric system.

7. The power supply system for a boat according to claim 1, further comprising a connection control device programmed to control a connection between the rectifier circuit and the auxiliary electric system, wherein the restricting device is arranged to control the connection control device to thereby stop the current supply to the auxiliary electric system.

8. The power supply system for a boat according to claim 7, further comprising a switch disposed at the connection between the auxiliary electric system and the rectifier circuit, wherein the switch is arranged to connect or disconnect the auxiliary electric system from the rectifier circuit.

9. The power supply system for a boat according to claim 1, wherein:

the auxiliary electric system includes the auxiliary equipment and the second storage battery;

the auxiliary electric system is arranged to supply electric power to the auxiliary equipment and to charge the second storage battery by the direct current output from the rectifier circuit; and the restricting device is arranged to restrict current supply to both the auxiliary equipment and the second storage battery of the auxiliary electric system when the deciding device decides to prioritize the main electric system.

10. The power supply system for a boat according to claim 1, wherein:

the auxiliary equipment includes a plurality of loads; and the first storage battery is arranged to be electrically isolated from at least one of the plurality of loads of the auxiliary equipment.

11. The power supply system for a boat according to claim 1, wherein:

the rectifier circuit is arranged to prevent current output from the first storage battery from being supplied to the second storage battery.

12. The power supply system for a boat according to claim 1, wherein the drive signal is generated by an engine control unit.

13. The power supply system for a boat according to claim 1, wherein the drive signal is based on an operation amount of a steering wheel of the boat.

14. A boat comprising:

a generator arranged to generate electric power in conjunction with driving of an internal combustion engine provided in a boat propulsion system;

a rectifier circuit arranged to convert an alternating current output from the generator to a direct current;

a main electric system arranged to supply electric power to a control system controlling the boat propulsion system, the main electric system including a first storage battery to be charged by the direct current output from the rectifier circuit;

an auxiliary electric system arranged to supply electric power to auxiliary equipment provided on the boat, the auxiliary electric system including a second storage battery to be charged by the direct current output from the rectifier circuit;

an actuating device arranged to actuate the boat propulsion system, the actuating device being connected to the main electric system;

a detector arranged to detect an operation signal supplied to the actuating device;

a deciding device arranged to decide, based on the operation signal detected by the detector, whether or not to prioritize the main electric system over the auxiliary electric system; and a restricting device arranged to restrict, when the deciding device decides to prioritize the main electric system, current supply to the auxiliary electric system before driving the actuating device to supply electric current to the main electric system in priority to the auxiliary electric system, and to drive the actuating device after the restriction of the current supply to the auxiliary electric system; wherein the actuating device includes a motor; and the operation signal is a drive signal to the motor, wherein the main electric system and the auxiliary electric system are connected in parallel with respect to each other and with respect to the rectifier circuit.

15. A control method of controlling a power supply system for a boat, the power supply system including a generator arranged to generate electric power in conjunction with driving of an internal combustion engine provided in a boat propulsion system, a rectifier circuit arranged to convert an alternating current output from the generator to a direct current, a main electric system arranged to supply electric power to a control system controlling the boat propulsion system, the main electric system including a first storage battery to be charged by the direct current output from the rectifier circuit, an auxiliary electric system arranged to supply electric power to auxiliary equipment provided on the boat, the auxiliary electric system including a second storage battery to be charged by the direct current output from the rectifier circuit, and an actuating device arranged to actuate the boat propulsion system, the actuating device being connected to the main electric system, the control method comprising the steps of:

detecting an operation signal supplied to the actuating device;

deciding, based on the detected operation signal, whether or not to prioritize the main electric system over the auxiliary electric system;

restricting, when it has been decided to prioritize the main electric system, current supply to the auxiliary electric system before driving the actuating device to supply electric current to the main electric system in priority to the auxiliary electric system; and driving the actuating device after the restricting of the current supply to the electric system; wherein the actuating device includes a motor; and the operation signal is a drive signal to the motor, wherein the main electric system and the auxiliary electric system are connected in parallel with respect to each other and with respect to the rectifier circuit.

16. The control method according to claim 15, wherein the actuating device is driven after the current supply to the auxiliary electric system has been restricted.

17. The control method according to claim 15, further comprising the step of calculating a drive current amount necessary to drive the actuating device based on the detected operation signal, wherein the step of restricting includes restricting the current supply to the auxiliary electric system based on the calculated drive current amount.

18. The control method according to claim 15, wherein the step of deciding comprises deciding to prioritize the main electric system over the auxiliary electric system in a case where a detected amount of change in the operation signal supplied to the actuating device is equal to or larger than a threshold value.

* * * * *